US007318556B2

(12) United States Patent
Lee et al.

(10) Patent No.: US 7,318,556 B2
(45) Date of Patent: Jan. 15, 2008

(54) WATER LINE SAFETY VALVE

(76) Inventors: Charles A. Lee, 3813 Berrybush La., Fort Worth, TX (US) 76137; Fredrick J. Arnato, 5965 Tenderfoot Trail, Fort Worth, TX (US) 76135

( * ) Notice: Subject to any disclaimer, the term of this patent is extended or adjusted under 35 U.S.C. 154(b) by 232 days.

(21) Appl. No.: 11/182,015

(22) Filed: Jul. 14, 2005

(65) Prior Publication Data

US 2006/0038043 A1 Feb. 23, 2006

Related U.S. Application Data

(60) Provisional application No. 60/588,285, filed on Jul. 15, 2004.

(51) Int. Cl.
*B67D 5/08* (2006.01)

(52) U.S. Cl. ..... 239/572; 239/570; 239/203; 239/204; 239/533.15; 137/68.14; 137/71; 137/517

(58) Field of Classification Search ..... 239/201, 239/203, 204–207, 570–572, 533.15; 137/71, 137/68.14, 329.4, 517, 519, 519.5
See application file for complete search history.

(56) References Cited

U.S. PATENT DOCUMENTS 4,716,937 A 1/1988 Hendrickson
4,762,140 A 8/1988 Davis
4,848,661 A * 7/1989 Palmer et al. ..... 239/204
4,867,603 A * 9/1989 Chang ..... 239/570
5,335,857 A * 8/1994 Hagon ..... 239/204
5,465,752 A * 11/1995 Higgins ..... 239/571
5,758,682 A * 6/1998 Cain ..... 137/68.14
5,857,487 A * 1/1999 Carson et al. ..... 239/533.15
6,178,982 B1 * 1/2001 Longstreth ..... 137/71
6,263,911 B1 * 7/2001 Brown et al. ..... 239/204
6,367,501 B2 * 4/2002 Svehaug ..... 239/571

* cited by examiner

*Primary Examiner*—Steven J. Ganey
(74) *Attorney, Agent, or Firm*—Bracewell & Giuliani LLP

(57) ABSTRACT

A safety valve for a lawn sprinkler system having at least one subterranean flow line and at least one head for spraying irrigation water. The valve includes a tubular member connected between the flow line and the head. The tubular member has an axial passage therethrough for the flow of water from the flow line to the head. A seat is located within the passage. A ball is located in the passage upstream of the seat. The ball is axially movable from an open position upstream of the seat to a closed position in engagement with the seat if the water flowing through passage reaches a selected flow rate. A coiled spring in the passage is in engagement with the ball for urging the ball toward the open position.

5 Claims, 3 Drawing Sheets

WATER LINE SAFETY VALVE

CROSS-REFERENCE TO RELATED APPLICATION

This application claims priority to provisional application Ser. No. 60/588,285, filed Jul. 15, 2004.

FIELD OF THE INVENTION

This invention relates in general to valves for water lines, and particularly to a safety valve for a water sprinkler system that stops the flow in the event of a malfunction.

BACKGROUND OF THE INVENTION

A typical lawn sprinkling system has lateral flow lines buried in various parts of the lawn, plant beds, and the like. One or more risers or sprinkler heads connect to each lateral flow line and extend upward to level at or above the surface of the ground. The sprinkler heads include types that pop up when supplied with water pressure as well as types that are stationary and have orifices located above the ground.

A solenoid operated valve is connected to the various flowlines for selectively applying water pressure for a timed interval. A controller controls the solenoid valve to automatically supply water pressure. The user can adjust the days for watering as well as the duration of timed intervals and the particular flow lines to receive water pressure.

If one of the heads breaks, an excessive amount of water will flow through the broken head for each timed interval. Because the controller is automatic and the owner not always present during watering intervals, the owner may not realize for some time that the head is broken. Various patents disclose devices to remedy excessive water discharge in the event of a sprinkler head breakage, but improvements are desired. For example, the safety valve member in some of the devices is located above ground in the riser. Typically, a failure is caused by breakage of the riser, and in these types of devices, the safety valve must be replaced after one failure.

SUMMARY OF THE INVENTION

In this invention, a flow line safety valve installs between the flow line and the outlet. The valve comprises a tubular member having a passage therethrough for the flow of fluid from the flow line. A seat located within the passage. A valve element is located in the passage upstream of the seat. The valve element is movable from an open position upstream of the seat to a closed position in engagement with the seat if the fluid flowing through passage reaches a selected flow rate. A spring biases the valve element toward the open position. If the flow rate increases above a selected maximum due to a malfunction, the flow pressure on the valve element causes the valve element to overcome the force of the spring and move to the closed position.

In one embodiment, the valve element is attached to the spring so as to place the spring in tension when moving to the closed position. In another embodiment, the valve element places the spring in compression when moving to the closed position.

DETAILED DESCRIPTION OF THE INVENTION

Figure 1:
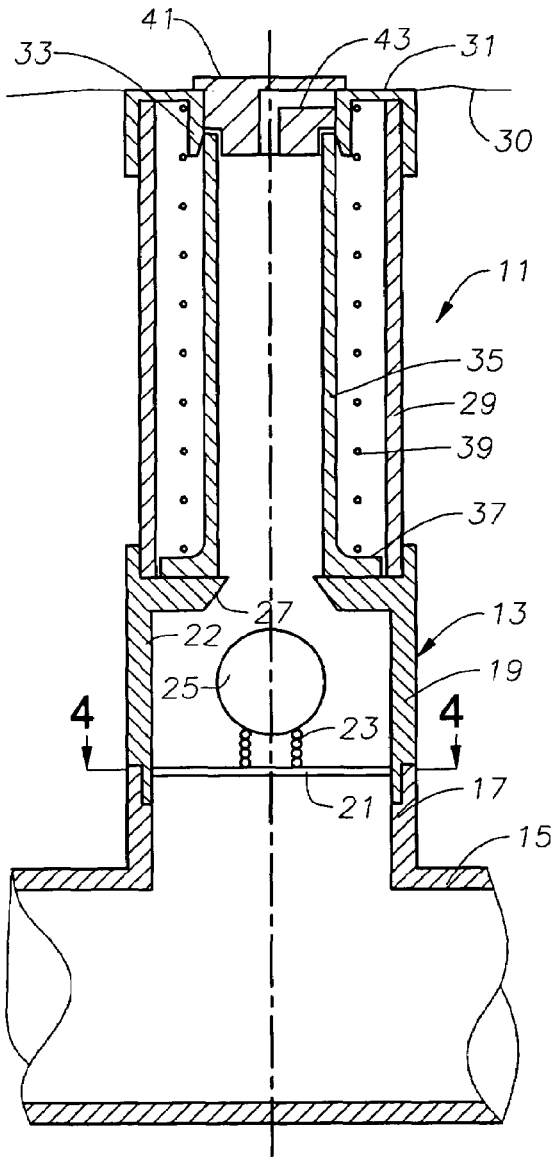
FIG. 1 is a vertical sectional view of a first embodiment of a safety valve in accordance with this invention shown installed with a sprinkler head.

Referring to FIG. 1, a sprinkler assembly 11 is schematically shown with a safety valve 13 constructed in accordance with this invention. Sprinkler assembly 11 may be of a number of different types and designs, and the particular one shown is for example only. Sprinkler assembly 11 includes a "T" or flow line junction 15 that connects into a buried water sprinkler flow line (not shown). Water pressure will be present in flow line junction 15 only when a remote solenoid valve (not shown) actuates to allow water flow. A remote controller (not shown) turns on and off the various solenoid valves. The user can adjust the controller to select the intervals between watering cycles, the duration of each watering cycle, and which flow line or circuit is to receive water pressure. Flow line junction 15 has an upward facing receptacle 17 which may have a threaded upper end.

Figure 4:
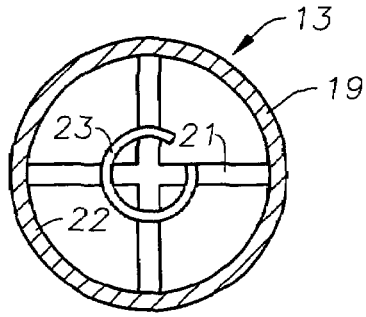
FIG. 4 is a sectional view of the safety valve of FIG. 1 taken along the line 4-4 of FIG. 1.

Safety valve 13 has a tubular body 19 that secures to receptacle 17, such as by threads. A retainer 21 is mounted within a central bore 22 in body 19. As illustrated in FIG. 4, retainer 21 in this example comprises a pair of thin rods mounted perpendicular to each other and to the side wall of bore 22. Rods 21 define apertures to allow water to pass through. Retainer 21 could be of a variety of types other than rods, such as a plate containing apertures.

A coil spring 23 has an upstream end secured to retainer 21 on the longitudinal axis of body 19. Coil spring 23 is normally in its natural state, not in tension. The upper end of coil spring 23 is secured to a ball 25. Ball 25 is of a rather firm elastomeric material in the preferred embodiment.

Figure 2:
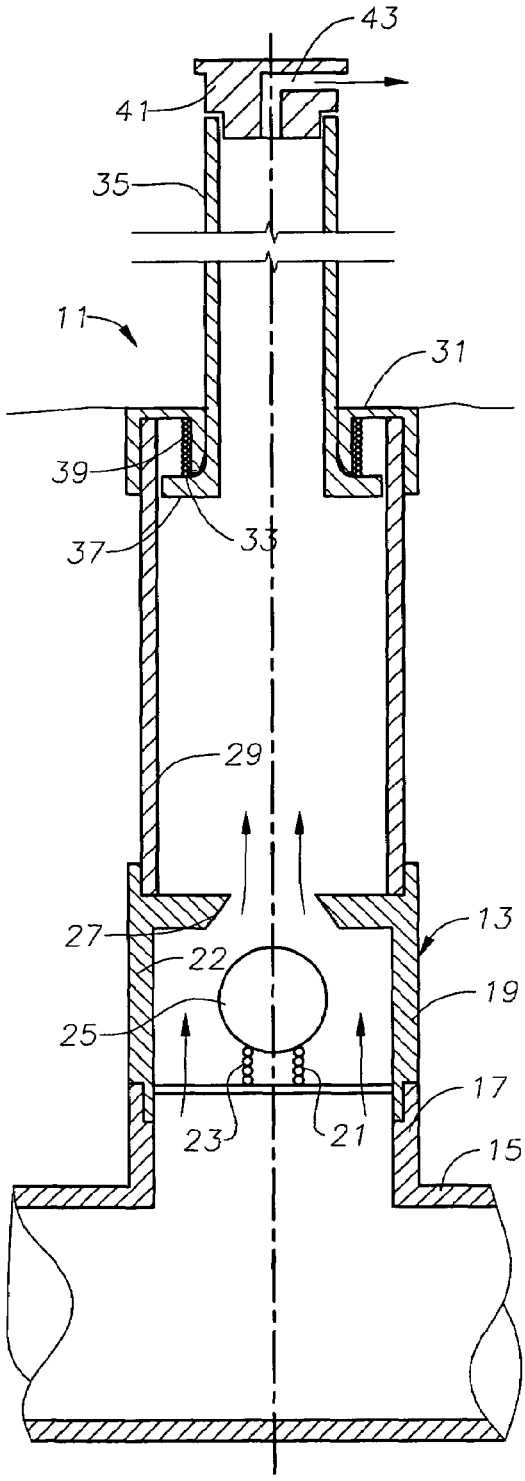
FIG. 2 is a view of the valve and sprinkler head of FIG. 1, showing the sprinkler head in an operational position.
Figure 3:
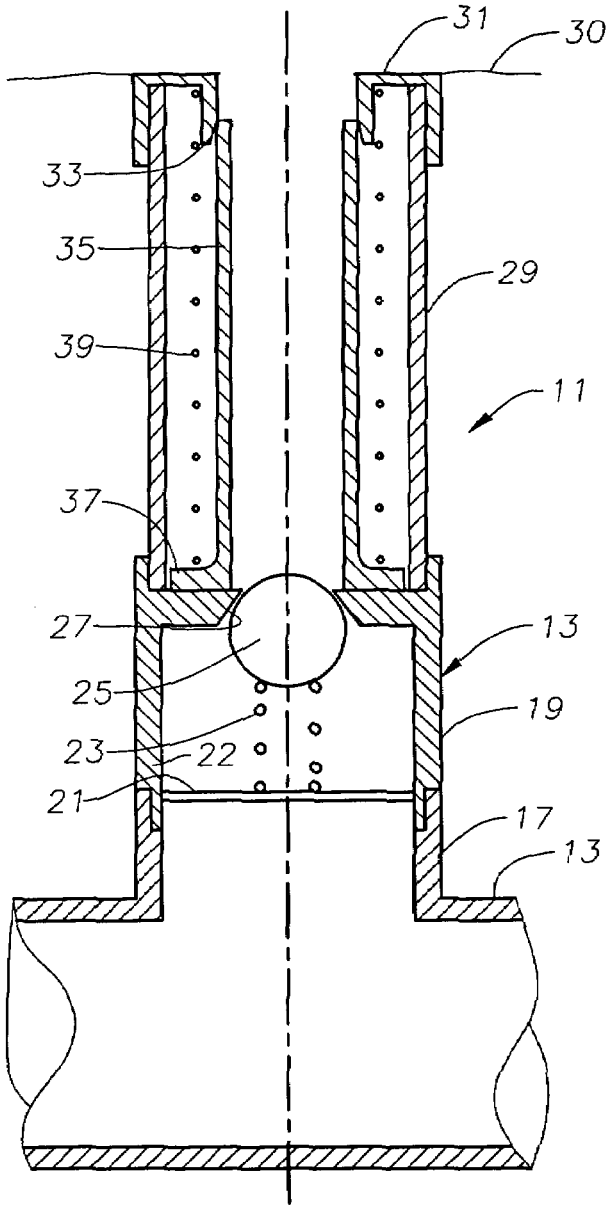
FIG. 3 is a sectional view of the sprinkler head and valve of FIG. 1, showing the orifice member removed and the valve in a closed position.

A downward facing seat 27 is formed in the upper end of body 19. Seat 27 is generally conical or a portion of a sphere for sealing when contacted by ball 25. Ball 25 will be located below seat 27 when no water pressure is present in junction 15. When water pressure is present, as shown in FIG. 2, and if the water flow through seat 27 is less than a selected flow rate, ball 25 will still be located below seat 27 because of the force of spring 23. If the water flow rate through seat 27 exceeds the selected maximum, as shown in FIG. 3, ball 25 will stretch spring 23, contact seat 27 and prevent flow through seat 27.

A conventional sprinkler head mounts to the downstream end of safety valve body 19. For example, the sprinkler head may include a riser 29 that secures to the upper end of safety valve body 19, preferably by threads. In the prior art, riser 29 would normally secure to receptacle 17. However in this invention, safety valve 13 locates between riser 29 and receptacle 17. Riser 29 could be integrally formed with valve body 19. Riser 29 is a tubular member having an upper end that may be flush with ground level 30 for lawn areas that are mowed, or optionally riser 29 may extend above ground 30, particularly if located in flower gardens or adjacent bushes. Safety valve 13 will normally be located below ground.

A cap 31 secures to the upper end of riser 29, normally by threads. Cap 31 has a tubular inner seal member 33 extending downward and concentrically located within the inner diameter of riser 29. Seal member 33 is shown as being integrally formed with cap 31, however it may be formed of a softer material and joined to cap 31. Seal member 33 may include an O-ring or other type of seal. In this embodiment, seal member 33 has an internal tapered surface located on its lower end for serving as a seal.

An extension tube 35 is slidably carried within riser 29 in this example. Extension tube 35 is a tubular member with a side wall that fits closely within the inner diameter of seal member 33. Extension tube 35 has a radially extending flange 37 on its lower end. A fillet is formed between flange 37 and the cylindrical portion of extension tube 35 for mating with the tapered surface on seal member 33 while in the upper position shown in FIG. 2. A coil spring 39 encircles extension tube 35 and biases extension tube 35 downward. Coil spring 39 has an upper end that engages cap 31 and a lower end that engages flange 37.

An orifice member 41 is located on the upper end of extension tube 35. In this example, orifice member 41 is secured by threads to extension tube 35, but it could be integrally formed. Orifice member 41 has an orifice 43 that has a selected circumferential pattern for directing a spray outward in a desired direction. For example, orifice 43 may extend 45 degrees, 90 degrees, 180 degrees or other amounts. Also, orifice members 41 with adjustable orifices 43 are available.

In operation, with no water pressure present in flow line junction 15, sprinkler assembly 11 will appear as shown in FIG. 1. Ball 25 will be spaced below seat 27. Extension tube 35 will be in its lower position. When a remote solenoid valve (not shown) opens, water pressure enters junction 15 and acts against extension tube 35, pushing it upward to the upper position shown in FIG. 2. The water pressure will compress coil spring 39, and flange 37 will abut and seal against seal member 33. Because of the small flow area of orifice 43 relative to the inner diameter of seat 27, the flow of water will not be sufficient to cause ball 25 to rise and seal against seat 27. The water flows past retainer 21, through seat 27 and out orifice 43. The tension of spring 23 is selected to prevent ball 25 from contacting seat 27 unless the flow rate exceeds a selected maximum.

FIG. 3 illustrates sprinkler assembly 11 in a malfunctioned condition. In this example, orifice member 41 has detached itself from extension tube 35 for one reason or another. Alternately, other malfunctions could exist, such as extension tube 35 cracking or breaking, which otherwise would allow substantial flow out through other portions of sprinkler head 11 rather than orifice 43 (FIG. 2). When the remote solenoid valve (not shown) turns on the water pressure, normally the water would flow out the extension tube 35 at a much higher rate than the normal flow rate through orifice 43. Unless the owner observes the malfunction, excessive water would be dispensed through the broken sprinkler assembly 11, and other sprinkler assemblies on the same circuit would possibly lack sufficient pressure to properly work.

Safety valve 13 avoids this occurrence, because the high flow rate of water will overcome the force of spring 23, and push ball 25 up into sealing engagement with seat 27. Ball 25 will prevent any water flow through extension tube 35 when sealed, enabling the remaining sprinkler heads on the same circuit to operate normally. When the water pressure is removed, ball 25 will return to its lower position shown in FIGS. 1 and 2. Ball 25 will again seal against seat 27 when water pressure is again returned. This will continue until the malfunctioning sprinkler assembly 11 is detected and repaired or replaced. Safety valve 13 can be re-used with the replacement sprinkler assembly 11.

Although shown utilizing a spring 23 that relies on tension to restrain ball 25, a compressive spring could alternately be utilized to prevent ball 25 from sealing unless the flow rate exceeds a certain level as shown in the embodiment of FIGS. 5-8. Safety valve 45 comprises a tubular member having an upper body 47 and a lower body 49 secured together, such as by threads, an adhesive, sonic welding, or other means. Lower body 49 has a threaded end 51 for securing to a flow line, such as flow line 15 (FIG. 1). Upper body 53 has a threaded receptacle 53 for connection to a sprinkler head assembly, such as riser 29 (FIG. 1). In the embodiment shown, upper body 47 has flats formed on its exterior for receiving a wrench to secure safety valve 45 between a flow line and a sprinkler head. An axial passage 55 extends through bodies 47, 49.

A partition 57 is formed in upper body 53 within passage 55. An inner tube 59 is molded integrally with or otherwise joined to partition 57 and extends downwardly or in an upstream direction. Inner tube 59 is smaller than the inner diameter of upper body 47 at that point. An annular recess 61 in partition 57 extends around inner tube 59.

A coiled spring 63 has an upper or downstream portion that locates in annular recess 61. Spring 63 encircles inner tube 59 and protrudes past inner tube 59 in an upstream direction. A valve element, such as ball 65, is carried in axial passage 55 for axial movement between a closed position and an open position. In the closed position, ball 65 seals against the open lower end of inner tube 59, that serves as a seat. In an open position, ball 65 is spaced below the open end of inner tube 59, as shown in the position shown in FIGS. 6 and 7. Spring 63 engages ball 65, urging it toward the open position. In this embodiment, spring 63 is smaller in diameter than ball 65. With no water flowing through passage 55, ball 65 will rest on an upward facing shoulder 69 in lower body 49.

Figure 6:
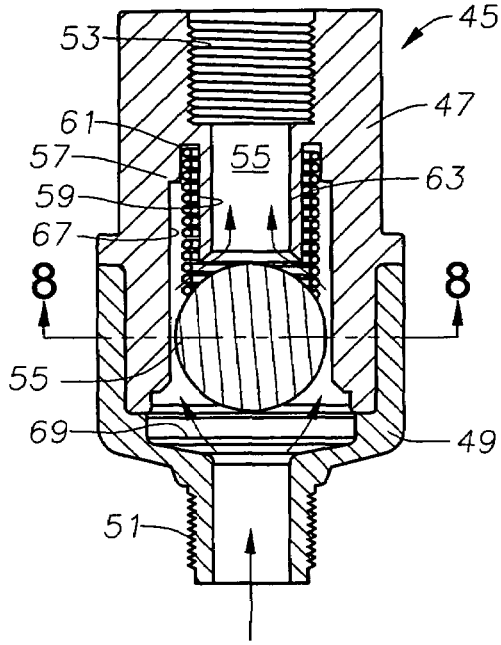
FIG. 6 is a sectional view of the valve of FIG. 5, taken along the line 6-6 of FIG. 5.
Figure 7:
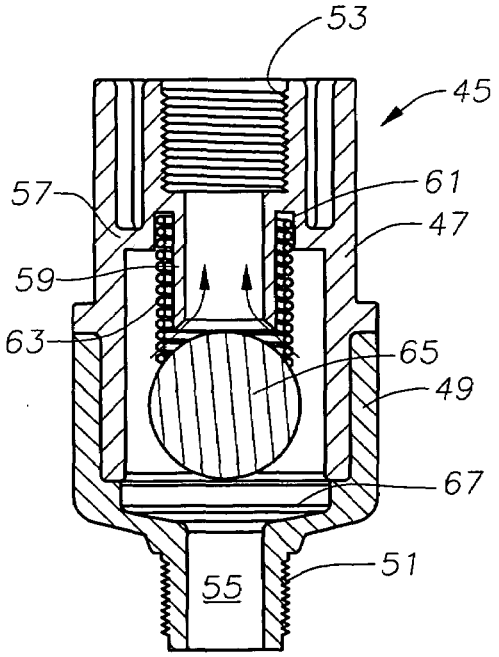
FIG. 7 is a sectional view of the valve of FIG. 6, taken along the line 7-7 of FIG. 5.
Figure 8:
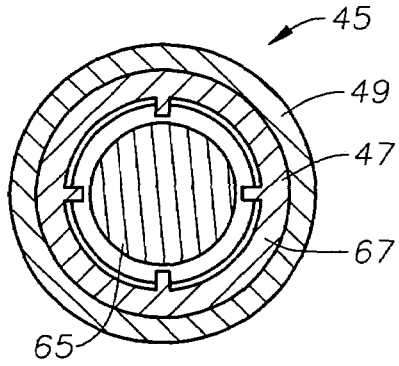
FIG. 8 is a sectional view of the valve of FIG. 5, taken along the line 8-8 of FIG. 6.

As shown in FIGS. 6 and 7 a plurality of guide ribs 67 extend inward from the inner surface of upper body 47. Guide ribs 67 extend axially from partition 57 to the lower end of upper body 47. Guide ribs 67 are spaced apart from each other and located circumferentially around ball 65. The diameter circumscribed by the interior surfaces of guide ribs 67 is slightly greater than the diameter of ball 65.

Figure 5:
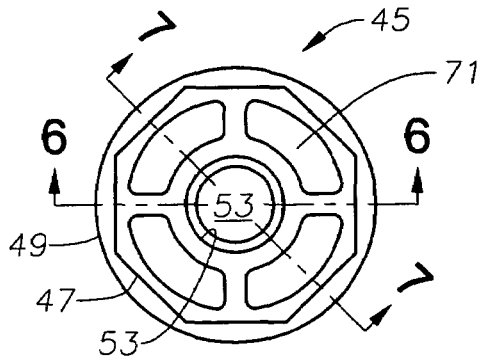
FIG. 5 is a top view of an alternate embodiment of a safety valve in accordance with this invention.

Referring to FIGS. 5 and 7, upper body 47 may optionally have cavities 71 formed therein for strengthening upper body 47. Preferably bodies 47, 49 are formed of plastic, and ball 65 is of an elastomeric material, such as nitrile rubber. Ball 65 is preferably not buoyant in water.

In the operation of the second embodiment, when the controller (not shown) supplies water pressure to passage 55, the water will flow around ball 65 and through inner tube 59 to the sprinkler head (not shown), as indicated by the arrows in FIGS. 6 and 7. If the sprinkler head functions properly, the flow rate will not be high enough to overcome the force of spring 63, causing ball 65 to remain generally in the position shown in FIG. 6. Because of the spherical shape of ball 65 and the clearances around ball 65 while in the open position, the pressure drop during normal operation is not significant. When the timed duration elapses, the water pressure stops and ball 65 drops to a position resting on shoulder 69.

If the sprinkler head is broken, the flow rate will be higher. The pressure of the water is sufficient to overcome the force of spring 63 and push ball 65 to the closed position in sealing engagement with the lower end of tube 59. This engagement completely blocks further water flow. Ball 65 will remain in that position until the timed interval is over and the water pressure removed by the controller. If the sprinkler head has not been replaced or repaired by the time of the next watering cycle, the water pressure will again cause ball 65 to move into sealing engagement with the lower end of tube 59. Ball 65 will block flow each time water pressure is supplied to safety valve 45 until the sprinkler head is repaired or replaced.

The invention has significant advantages. The safety valve moves to a closed position completely blocking water flow when an excessive flow rate is detected. If a sprinkler head breaks, the safety valve avoids wasting water. The safety valve resets itself with each subsequent watering cycle. The safety valve can be installed at any attitude or angle, other than just vertical. The safety valve can be re-used with a new sprinkler head that replaces a broken one.

While the invention has been shown in only one of its forms, it should be apparent to those skilled in the art that it is not so limited but is susceptible to various changes without departing from the scope of the invention. For example, rather than a separate coiled spring in the first embodiment, the bias member could be an elastic strap integrally formed with the ball. The safety valve may be useful for flow lines other than sprinklers, such as the water lines to clothes washing machines.

The invention claimed is:

1. A flow line safety valve, comprising:

a tubular member for connection to the flow line, the tubular member having a passage therethrough for the flow of fluid from the flow line;

a seat located within the passage;

a valve element located in the passage upstream of the seat, the valve element being movable from an open position upstream of the seat to a closed position in engagement with the seat if the fluid flowing through passage reaches a selected flow rate;

a bias member that biases the valve element toward the open position;

a tube located within the passage, the tube protruding in an upstream direction from an annular shoulder;

the tube having an open upstream end that is sealingly contacted by the valve element while in the closed position and which serves as the seat; and wherein the bias member comprises a coiled spring that has a downstream portion encircling the tube and bearing against the shoulder, the coiled spring having an upstream end that engages the valve element.

2. The safety valve according to claim 1, further comprising:

a guide member in the passage around the coiled spring and the valve element, the guide member having apertures to allow flow of fluid therethrough while the valve element is in the open position.

3. The safety valve according to claim 1, wherein the valve element comprises a ball.

4. In a lawn sprinkler system having at least one subterranean flow line and at least one head in fluid communication with the flow line for spraying irrigation water therefrom, the improvement comprising:

a tubular member between the flow line and the head, the tubular member having an axial passage therethrough for the flow of water from the flow line to the head;

a seat located within the passage;

a ball located in the passage upstream of the seat, the ball being axially movable from an open position upstream of the seat to a closed position in engagement with the seat if the water flowing through the passage past the ball reaches a selected flow rate; and a spring in the passage having an upstream end stationarily mounted to the tubular member and a downstream end attached to an upstream portion of the ball, such that if the selected flow rate is reached, the ball stretches the spring and moves to the closed position.

5. In a lawn sprinkler system having at least one subterranean flow line and at least one head in fluid communication with the flow line for spraying irrigation water therefrom, the improvement comprising:

a tubular member between the flow line and the head, the tubular member having an axial passage therethrough for the flow of water from the flow line to the head;

a seat located within the passage;

a ball located in the passage upstream of the seat, the ball being axially movable from an open position upstream of the seat to a closed position in engagement with the seat if the water flowing through the passage reaches a selected flow rate;

a coiled spring in the passage in engagement with the ball for urging the ball toward the open position;

a stationary retainer located in the passage upstream of the ball, the retainer having an aperture therethrough to allow the passage of water;

the spring having an upstream end attached to the retainer; and the spring having a downstream end attached to the ball for movement therewith.

* * * * *

UNITED STATES PATENT AND TRADEMARK OFFICE

CERTIFICATE OF CORRECTION

PATENT NO. : 7,318,556 B2 
APPLICATION NO. : 11/182015
DATED : January 15, 2008
INVENTOR(S) : Charles A. Lee et al.

It is certified that error appears in the above-identified patent and that said Letters Patent is hereby corrected as shown below:

Page 1, COVER PAGE:

(76) Inventors:

delete "Fredrick J. Arnato" and substitute --Fredrick J. Amato--

Signed and Sealed this

Second Day of June, 2009

JOHN DOLL
*Acting Director of the United States Patent and Trademark Office*